US011488573B2

(12) United States Patent
Mars et al.

(10) Patent No.: US 11,488,573 B2
(45) Date of Patent: Nov. 1, 2022

(54) ACOUSTIC OBJECT EXTRACTION DEVICE AND ACOUSTIC OBJECT EXTRACTION METHOD

(71) Applicant: Panasonic Intellectual Property Corporation of America, Torrance, CA (US)

(72) Inventors: Rohith Mars, Singapore (SG); Srikanth Nagisetty, Singapore (SG); Chong Soon Lim, Singapore (SG); Hiroyuki Ehara, Kanagawa (JP); Akihisa Kawamura, Osaka (JP)

(73) Assignee: PANASONIC INTELLECTUAL PROPERTY CORPORATION OF AMERICA, Torrance, CA (US)

( * ) Notice: Subject to any disclaimer, the term of this patent is extended or adjusted under 35 U.S.C. 154(b) by 30 days.

(21) Appl. No.: 17/257,413

(22) PCT Filed: Sep. 6, 2019

(86) PCT No.: PCT/JP2019/035099

§ 371 (c)(1),
(2) Date: Dec. 31, 2020

(87) PCT Pub. No.: WO2020/066542

PCT Pub. Date: Apr. 2, 2020

(65) Prior Publication Data

US 2021/0183356 A1 Jun. 17, 2021

(30) Foreign Application Priority Data

Sep. 26, 2018 (JP) ..... JP2018-180688

(51) Int. Cl.
*G10K 11/34* (2006.01)
*H04R 1/40* (2006.01)

(52) U.S. Cl.
CPC ..... *G10K 11/34* (2013.01); *H04R 1/406* (2013.01)

(58) Field of Classification Search
CPC ..... G10K 11/34; G10K 11/343; H04R 1/406; H04R 1/40; H04R 2430/03;
(Continued)

(56) References Cited

U.S. PATENT DOCUMENTS

2013/0258813 A1* 10/2013 Herre ..... H04R 3/005 367/135

FOREIGN PATENT DOCUMENTS

JP 2003-284185 10/2003
JP 2004-289762 10/2004
(Continued)

OTHER PUBLICATIONS

Kaplun et al. "Application of Polyphase Filter Banks to Wideband Monitoring Tasks", Proc of IEEE NW Russia Young Researchers in Electrical Engineering Coference, IEEE, p. 95-98, (Year: Feb. 3, 2014).*

(Continued)

*Primary Examiner* — Leshui Zhang
(74) *Attorney, Agent, or Firm* — Greenblum & Bernstein, P.L.C.

(57) ABSTRACT

In the acoustic object extraction device, beam forming processing units generate a first acoustic signal by beam forming in an arrival direction of a signal from an acoustic object with respect to a microphone array and generate a second acoustic signal by beam forming in an arrival direction of a signal from the acoustic object with respect to a microphone array, and a common component extraction unit extracts, on the basis of a similarity between the spectrum of the first acoustic signal and the spectrum of the second acoustic signal and from the first acoustic signal and the (Continued)

second acoustic signal, a signal containing a common component corresponding to the acoustic object. The common component extraction unit divides the spectrums of the first acoustic signal and the second acoustic signal into a plurality of frequency sections and calculates a similarity for each of the frequency sections.

10 Claims, 6 Drawing Sheets

(58) Field of Classification Search
CPC ..... H04R 2430/23; H04R 3/00; H04R 3/002; H04R 3/005; H04R 5/04; G10L 21/0208; G10L 21/0272; G10L 21/028; G10L 21/02; G10L 19/00; G10L 19/008; G10L 15/20
USPC ..... 381/13, 16, 23, 23.1, 26, 56, 57, 61, 66, 381/313, 316, 320, 321, 71.1, 71.3, 71.6, 381/71.11, 71.12, 71.13, 71.14, 73.1, 74, 381/79, 86, 91, 92, 94.1, 94.2, 94.3, 94.5, 381/94.6, 94.9, 95, 97, 98, 99, 100, 101, 381/102, 103, 110, 111, 112, 113, 114, 381/115, 119, 122, 123; 704/226, 227, 704/228, 231, 233, E15.039, E15.041, 704/E19.014, E21.002, E21.007, E21.014, 704/E21.015; 700/94
See application file for complete search history.

(56) References Cited

FOREIGN PATENT DOCUMENTS

JP 2004289762 A * 10/2004
JP 2014-502108 1/2014

OTHER PUBLICATIONS

Zheng et al., "Collaborative blind source separation using location informed spatial microphones", IEEE Signal Processing Letters, vol. 20, (1), 2013, pp. 83-86.
Zheng et al., "Encoding and communicating navigable speech soundfields", Multimedia Tools and Applications 75.9, 2016, pp. 5183-5204.
International Search Report issued in International Pat. Appl. No. PCT/JP2019/035099, dated Oct. 21, 2019, along with an English translation thereof.

* cited by examiner

ACOUSTIC OBJECT EXTRACTION DEVICE AND ACOUSTIC OBJECT EXTRACTION METHOD

TECHNICAL FIELD

The present disclosure relates to an acoustic object extraction apparatus and an acoustic object extraction method.

BACKGROUND ART

As a method of extracting an acoustic object (for example, referred to as a spatial object sound) using a plurality of acoustic beamformers, a method has been proposed in which, for example, signals inputted from two acoustic beamformers are transformed into a spectral domain using a filter bank, and a signal corresponding to an acoustic object is extracted based on a cross spectral density in the spectral domain (see, for example, Patent Literature (hereinafter referred to as "PTL") 1).

CITATION LIST

Patent Literature

PTL 1
Japanese Unexamined Patent Application Publication (Translation of PCT Application) No. 2014-502108

Non-Patent Literature

NPL 1
Zheng, Xiguang, Christian Ritz, and Jiangtao Xi. "Collaborative blind source separation using location informed spatial microphones." IEEE signal processing letters (2013): 83-86.
NPL 2
Zheng, Xiguang, Christian Ritz, and Jiangtao Xi. "Encoding and communicating navigable speech soundfields." Multimedia Tools and Applications 75.9 (2016): 5183-5204.

SUMMARY OF INVENTION

However, the method of extracting an acoustic object sound has not been studied comprehensively.

One non-limiting and exemplary embodiment facilitates providing an acoustic object extraction apparatus and an acoustic object extraction method capable of improving the extraction performance of an acoustic object sound.

An acoustic object extraction apparatus according to an exemplary embodiment of the present disclosure includes: beamforming processing circuitry, which, in operation, generates a first acoustic signal by beamforming in a direction of arrival of a signal from an acoustic object to a first microphone array, and generates a second acoustic signal by beamforming in a direction of arrival of a signal from the acoustic object to a second microphone array; and extraction circuitry, which, in operation, extracts a signal including a common component corresponding to the acoustic object from the first acoustic signal and the second acoustic signal based on a degree of similarity between a spectrum of the first acoustic signal and a spectrum of the second acoustic signal, in which the extraction circuitry divides the spectra of the first acoustic signal and the second acoustic signal into a plurality of frequency sections and calculates the degree of similarity for each of the plurality of frequency sections.

An acoustic object extraction method according to an exemplary embodiment of the present disclosure includes: generating a first acoustic signal by beamforming in a direction of arrival of a signal from an acoustic object to a first microphone array, and generating a second acoustic signal by beamforming in a direction of arrival of a signal from the acoustic object to a second microphone array; and extracting a signal including a common component corresponding to the acoustic object from the first acoustic signal and the second acoustic signal based on a degree of similarity between a spectrum of the first acoustic signal and a spectrum of the second acoustic signal, in which the spectra of the first acoustic signal and the second acoustic signal are divided into a plurality of frequency sections and the degree of similarity is calculated for each of the plurality of frequency sections.

Note that these generic or specific aspects may be achieved by a system, an apparatus, a method, an integrated circuit, a computer program, or a recoding medium, and also by any combination of the system, the apparatus, the method, the integrated circuit, the computer program, and the recoding medium.

According to an exemplary embodiment of the present disclosure, it is possible to improve the extraction performance of an acoustic object sound.

Additional benefits and advantages of one aspect of the disclosed embodiments will become apparent from the specification and drawings. The benefits and/or advantages may be individually obtained by the various embodiments and features of the specification and drawings, which need not all be provided in order to obtain one or more of such benefits and/or advantages.

DESCRIPTION OF EMBODIMENTS

Hereinafter, an embodiment of the present disclosure will be described in detail with reference to the accompanying drawings.

[Outline of System]

A system (e.g., an acoustic navigation system) according to the present embodiment includes at least acoustic object extraction apparatus 100.

In the system according to the present embodiment, acoustic object extraction apparatus 100, for example, extracts a signal of a target acoustic object (e.g., a spatial object sound) and the position of the acoustic object using a plurality of acoustic beamformers, and outputs information on the acoustic object (including signal information and position information, for example) to another apparatus (for example, a sound field reproduction apparatus) (not illustrated). For example, the sound field reproduction apparatus reproduces (renders) the acoustic object using the information on the acoustic object outputted from acoustic object extraction apparatus 100 (see, for example, Non-Patent Literatures (hereinafter referred to as "NPLs") 1 and 2).

Note that, when the sound field reproduction apparatus and acoustic object extraction apparatus 100 are installed at locations distant from each other, the information on the acoustic object may be compressed and encoded, and transmitted to the sound field reproduction apparatus through a transmission channel.

Figure 1:
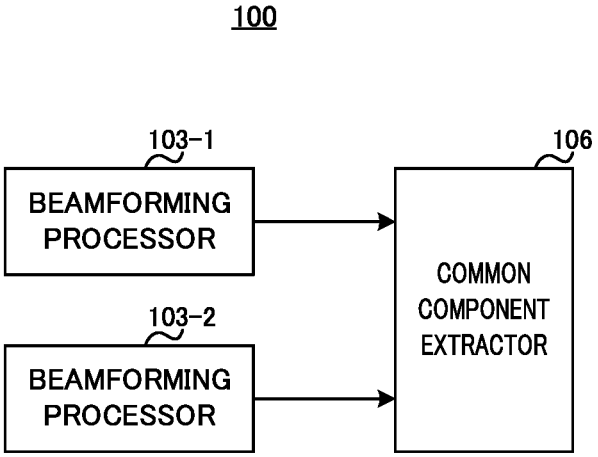
FIG. 1 is a block diagram illustrating an exemplary configuration of a part of an acoustic object extraction apparatus according to an embodiment.

FIG. 1 is a block diagram illustrating a configuration of a part of acoustic object extraction apparatus 100 according to the present embodiment. In acoustic object extraction apparatus 100 illustrated in FIG. 1, beamforming processors 103-1 and 103-2 generate a first acoustic signal by beamforming in the direction of arrival of a signal from an acoustic object to a first microphone array and generate a second acoustic signal by beamforming in the direction of arrival of a signal from the acoustic object to a second microphone array. Common component extractor 106 extracts a signal including a common component corresponding to the acoustic object from the first acoustic signal and the second acoustic signal based on the degree of similarity between the spectrum of the first acoustic signal and the spectrum of the second acoustic signal. At this time, common component extractor 106 divides the spectra of the first acoustic signal and the second acoustic signal into a plurality of frequency sections (for example, referred to as subbands or segments) and calculates the degree of similarity for each of the frequency sections.

[Configuration of Acoustic Object Extraction Apparatus]

Figure 2:
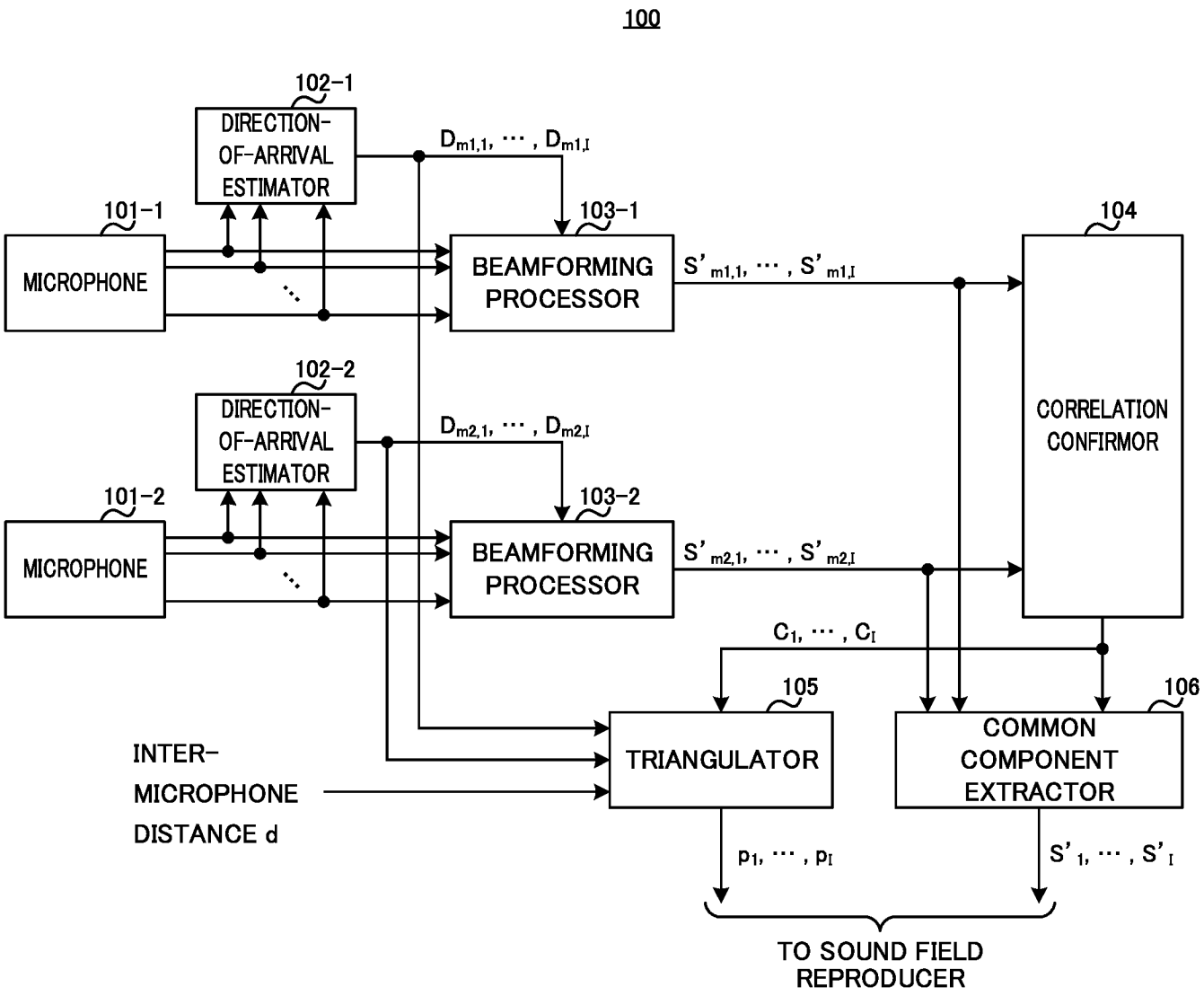
FIG. 2 is a block diagram illustrating an exemplary configuration of the acoustic object extraction apparatus according to an embodiment.

FIG. 2 is a block diagram illustrating an exemplary configuration of acoustic object extraction apparatus 100 according to the present embodiment. In FIG. 2, acoustic object extraction apparatus 100 includes microphone arrays 101-1 and 101-2, direction-of-arrival estimators 102-1 and 102-2, beamforming processors 103-1 and 103-2, correlation confirmor 104, triangulator 105, and common component extractor 106.

Microphone array 101-1 obtains (e.g., records) a multichannel acoustic signal (or a speech acoustic signal), transforms the acoustic signal into a digital signal (digital multichannel acoustic signal), and outputs it to direction-of-arrival estimator 102-1 and beamforming processor 103-1.

Microphone array 101-2 obtains (e.g., records) a multichannel acoustic signal, transforms the acoustic signal into a digital signal (digital multichannel acoustic signal), and outputs it to direction-of-arrival estimator 102-2 and beamforming processor 103-2.

Figure 3:
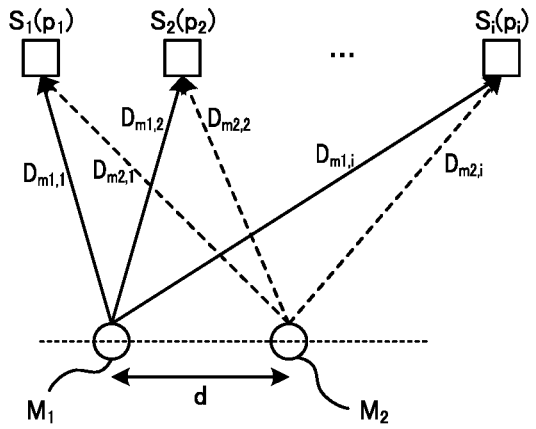
FIG. 3 illustrates an example of the positional relationship between microphone arrays and acoustic objects.

Microphone array 101-1 and microphone array 101-2 are, for example, High-order Ambisonics (HOA) microphones (ambisonics microphones). For example, as illustrated in FIG. 3, the distance between the position of microphone array 101-1 (denoted by "$M_1$" in FIG. 3) and the position of microphone array 101-2 (denoted by "$M_2$" in FIG. 3) (inter-microphone-array distance) is denoted by "d."

Direction-of-arrival estimator 102-1 estimates the direction of arrival of the acoustic object signal to microphone array 101-1 (in other words, performs Direction of Arrival (DOA) estimation) using the digital multichannel acoustic signal inputted from microphone array 101-1. For example, as illustrated in FIG. 3, direction-of-arrival estimator 102-1 outputs, to beamforming processor 103-1 and triangulator 105, direction-of-arrival information ($D_{m1,1}$, . . . , $D_{m1,I}$) indicating the directions of arrival of I acoustic objects to microphone array 101-1 ($M_1$).

Direction-of-arrival estimator 102-2 estimates the direction of arrival of the acoustic object signal to microphone array 101-2 using the digital multichannel acoustic signal inputted from microphone array 101-2. For example, as illustrated in FIG. 3, direction-of-arrival estimator 102-2 outputs, to beamforming processor 103-2 and triangulator 105, direction-of-arrival information ($D_{m2,1}$, . . . , $D_{m2m,I}$) indicating the directions of arrival of I acoustic objects to microphone array 101-2 ($M_2$).

Beamforming processor 103-1 forms a beam in each of the directions of arrival based on the direction-of-arrival information ($D_{m1,1}$, . . . , $D_{m1,I}$) inputted from direction-of-arrival estimator 102-1, and performs beamforming processing on the digital multichannel acoustic signal inputted from microphone array 101-1. Beamforming processor 103-1 outputs, to correlation confirmor 104 and common component extractor 106, first acoustic signals ($S'_{m1,1}$, . . . , $S'_{m1,I}$) in the respective directions of arrival (e.g., I directions) generated by beamforming in the directions of arrival of the acoustic object signals to microphone array 101-1.

Beamforming processor 103-2 forms a beam in each of the directions of arrival based on the direction-of-arrival information ($D_{m2,1}$, . . . , $D_{m2,I}$) inputted from direction-of-arrival estimator 102-2, and performs beamforming processing on the digital multichannel acoustic signal inputted from microphone array 101-2. Beamforming processor 103-2 outputs, to correlation confirmor 104 and common component extractor 106, second acoustic signals ($S'_{m2,1}$, . . . , $S'_{m2,I}$) in the respective directions of arrival (e.g., I directions) generated by beamforming in the directions of arrival of the acoustic object signals to microphone array 101-2.

Correlation confirmor 104 confirms (in other words, performs a correlation test) the correlation between the first acoustic signals ($S'_{m1,1}$, . . . , $S'_{m1,I}$) inputted from beamforming processor 103-1 and the second acoustic signals ($S'_{m2,1}$, . . . , $S'_{m2,I}$) inputted from beamforming processor 103-2. Correlation confirmor 104 identifies a combination that is signals of same acoustic object i (i=1 to I) among the first acoustic signals and the second acoustic signals based on a confirmation result on the correlation. Correlation confirmor 104 outputs combination information (for example, $C_1$, . . . , $C_I$) indicating combinations that are signals of the same acoustic objects to triangulator 105 and common component extractor 106.

For example, among the first acoustic signals ($S'_{m1,1}$, . . . , $S'_{m1,I}$), the acoustic signal corresponding to the ith acoustic object ("i" is any value of 1 to I) is represented as "$S'_{m1,ci[0]}$." Likewise, among the second acoustic signals ($S'_{m2,1}$, $S'_{m2,I}$), the acoustic signal corresponding to the ith acoustic object ("i" is any value of 1 to I) is represented as "$S'_{m1,ci[1]}$." In this case, combination information Ci of the first acoustic signal and the second acoustic signal corresponding to the ith acoustic object is composed of {ci[0], ci[1]}. Triangulator 105 calculates the positions of the acoustic objects (for example, I acoustic objects) using the direction-of-arrival information ($D_{m1,1}$, . . . , $D_{m1,I}$) inputted from direction-of-arrival estimator 102-1, the direction-of-arrival information ($D_{m2,1}$, . . . , $D_{m2,1}$) inputted from direction-of-arrival estimator 102-2, the inputted inter-microphone-array distance information (d), and the combination information ($C_1$ to $C_I$) inputted from correlation confirmor 104. Triangulator 105 outputs position information (e.g., $p_1$, . . . , $p_I$) indicating the calculated positions.

For example, in FIG. 3, position $p_1$ of the first (i=1) acoustic object is calculated by triangulation using inter-microphone-array distance d, direction of arrival $D_{m1,c[0]}$ of the first acoustic object signal to microphone array 101-1 ($M_1$), and direction of arrival $D_{m2,c1[i]}$ of the first acoustic object signal to microphone array 101-2 ($M_2$). The same applies to the positions of other acoustic objects.

Common component extractor 106 extracts a component common to two acoustic signals (in other words, signals including a common component corresponding to each of acoustic objects) from the two acoustic signals as a combination indicated in the combination information ($C_1$ to $C_I$) inputted from correlation confirmor 104 which is a combination of one of the first acoustic signals ($S'_{m1,1}, \ldots, S'_{m1,I}$) inputted from beamforming processor 103-1 and one of the second acoustic signal ($S'_{m2,1}, \ldots, S'_{m2,I}$) inputted from beamforming processor 103-2. Common component extractor 106 outputs the extracted acoustic object signals ($S'_1, \ldots, S'_I$).

For example, in FIG. 3, there is a possibility that another acoustic object (not illustrated), noise, or the like other than the first acoustic object as a target for extraction is mixed in the first acoustic signals in the direction between microphone array 101-1 ($M_1$) and the first (i=1) acoustic object (solid-line arrow). Likewise, in FIG. 3, there is a possibility that another acoustic object (not illustrated), noise, or the like other than the first acoustic object as the target for extraction is mixed in the second acoustic signals in the direction between microphone array 101-2 ($M_2$) and the first (i=1) acoustic object (broken-line arrow). Note that, the same applies to other acoustic objects than the first acoustic object.

Common component extractor 106 extracts common components in the spectra of the first acoustic signals and the second acoustic signals (in other words, outputs of a plurality of acoustic beamformers), and outputs first (i=1) acoustic object signal $S'_1$. For example, common component extractor 106 causes the component of a target acoustic object for extraction in the spectra of the first acoustic signals and the second acoustic signals to be left, while attenuates components of other acoustic objects or noise by multiplication (in other words, weighting processing) by a spectral gain, which will be described below.

The position information ($p_1, \ldots, p_I$) outputted from triangulator 105 and the acoustic object signals ($S'_1, \ldots, S'_I$) outputted from common component extractor 106 are outputted to, for example, the sound field reproduction apparatus (not illustrated) and used for reproducing (rendering) the acoustic objects.

[Operation of Common Component Extractor 106]

Next, the operation of common component extractor 106 illustrated in FIG. 1 will be described in detail.

Figure 4:
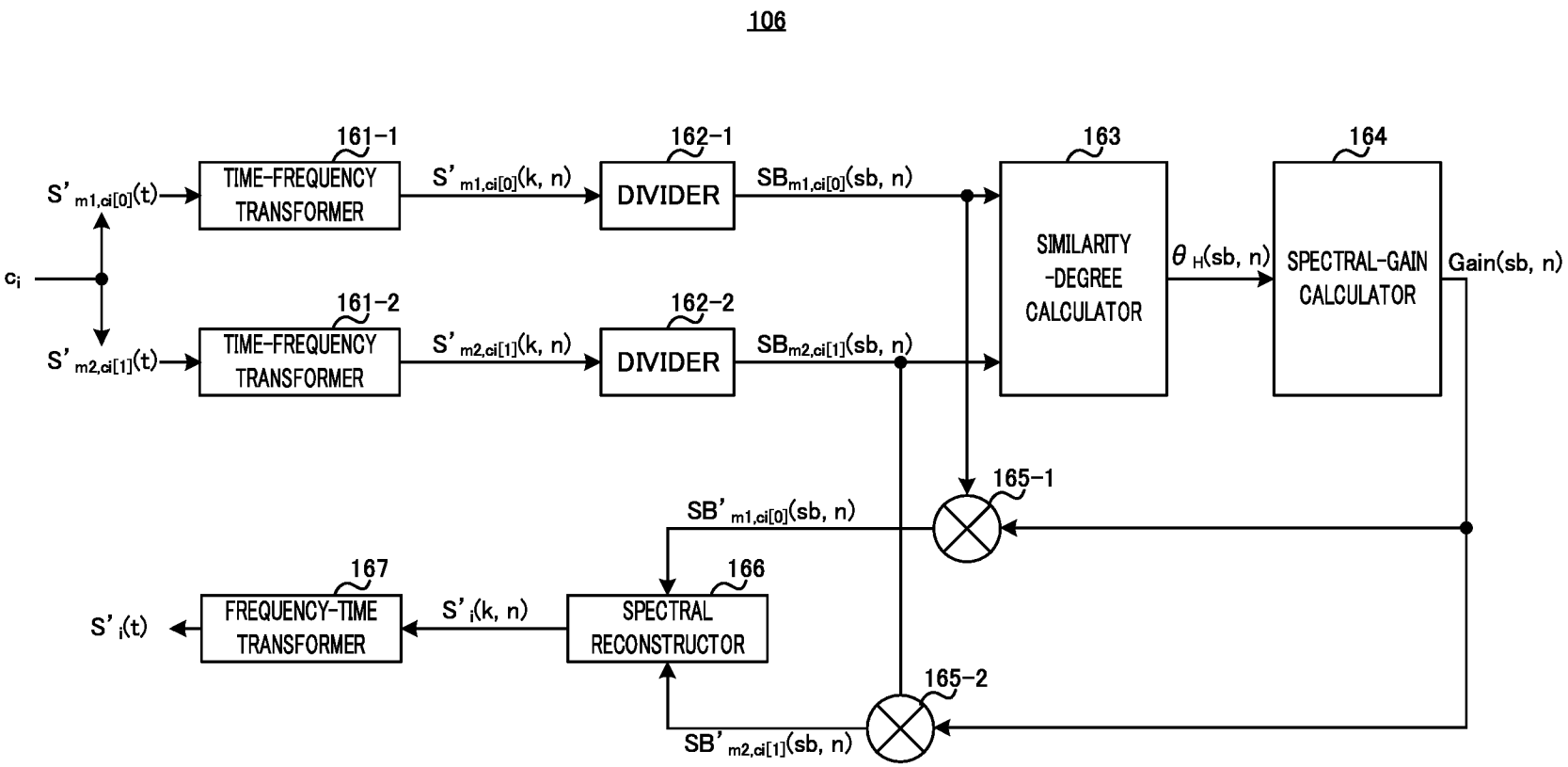
FIG. 4 is a block diagram illustrating an example of an internal configuration of a common component extractor according to an embodiment.

FIG. 4 is a block diagram illustrating an example of an internal configuration of common component extractor 106. In FIG. 4, common component extractor 106 is configured to include time-frequency transformers 161-1 and 161-2, dividers 162-1 and 162-2, similarity-degree calculator 163, spectral-gain calculator 164, multipliers 165-1 and 165-2, spectral reconstructor 166, and frequency-time transformer 167.

For example, first acoustic signal $S'_{m1,ci[0]}(t)$ corresponding to ci[0] indicated in combination information $C_i$ ("i" is any one of 1 to I) is inputted to time-frequency transformer 161-1. Time-frequency transformer 161-1 transforms first acoustic signal $S'_{m1,ci[0]}(t)$ (time-domain signal) into a signal (spectrum) in the frequency domain. Time-frequency transformer 161-1 outputs spectrum $S'_{m1,ci[0]}(k,n)$ of the obtained first acoustic signal to divider 162-1.

Note that, "k" indicates the frequency index (e.g., frequency bin number), and "n" indicates the time index (e.g., frame number in the case of framing of an acoustic signal at predetermined time intervals).

For example, second acoustic signal $S'_{m2,c[1]}(t)$ corresponding to ci[1] illustrated in combination information $C_i$ ("i" is any one of 1 to I) is inputted to time-frequency transformer 161-2. Time-frequency transformer 161-2 transforms second acoustic signal $S'_{m2,ci[1]}(t)$ (time-domain signal) into a signal (spectrum) in the frequency domain. Time-frequency transformer 161-2 outputs spectrum $S'_{m2,ci[1]}(k,n)$ of the obtained second acoustic signal to divider 162-2.

Note that, the time-frequency transform processing of time-frequency transformers 161-1 and 161-2 may be, for example, Fourier transform processing (e.g., Short-time Fast Fourier Transform (SFFT)) or Modified Discrete Cosine Transform (MDCT).

Divider 162-1 divides, into a plurality of frequency segments (hereinafter, referred to as "subbands"), spectrum $S'_{m1,ci[0]}(k,n)$ of the first acoustic signal inputted from time-frequency transformer 161-1. Divider 162-1 outputs, to similarity-degree calculator 163 and multiplier 165-1, a subband spectrum ($SB_{m1,ci[0]}(sb, n)$) formed by spectrum $S'_{m1,ci[0]}(k,n)$ of the first acoustic signal included in each subband.

Note that "sb" represents a subband number.

Divider 162-2 divides, into a plurality of subbands, spectrum $S'_{m2,ci[1]}(k,n)$ of the second acoustic signal inputted from time-frequency transformer 161-2. Divider 162-2 outputs, to similarity-degree calculator 163 and multiplier 165-2, a subband spectrum ($SB_{m2,ci[1]}(sb, n)$) formed by spectrum $S'_{m2,ci[1]}(k,n)$ of the second acoustic signal included in each subband.

Figure 5:
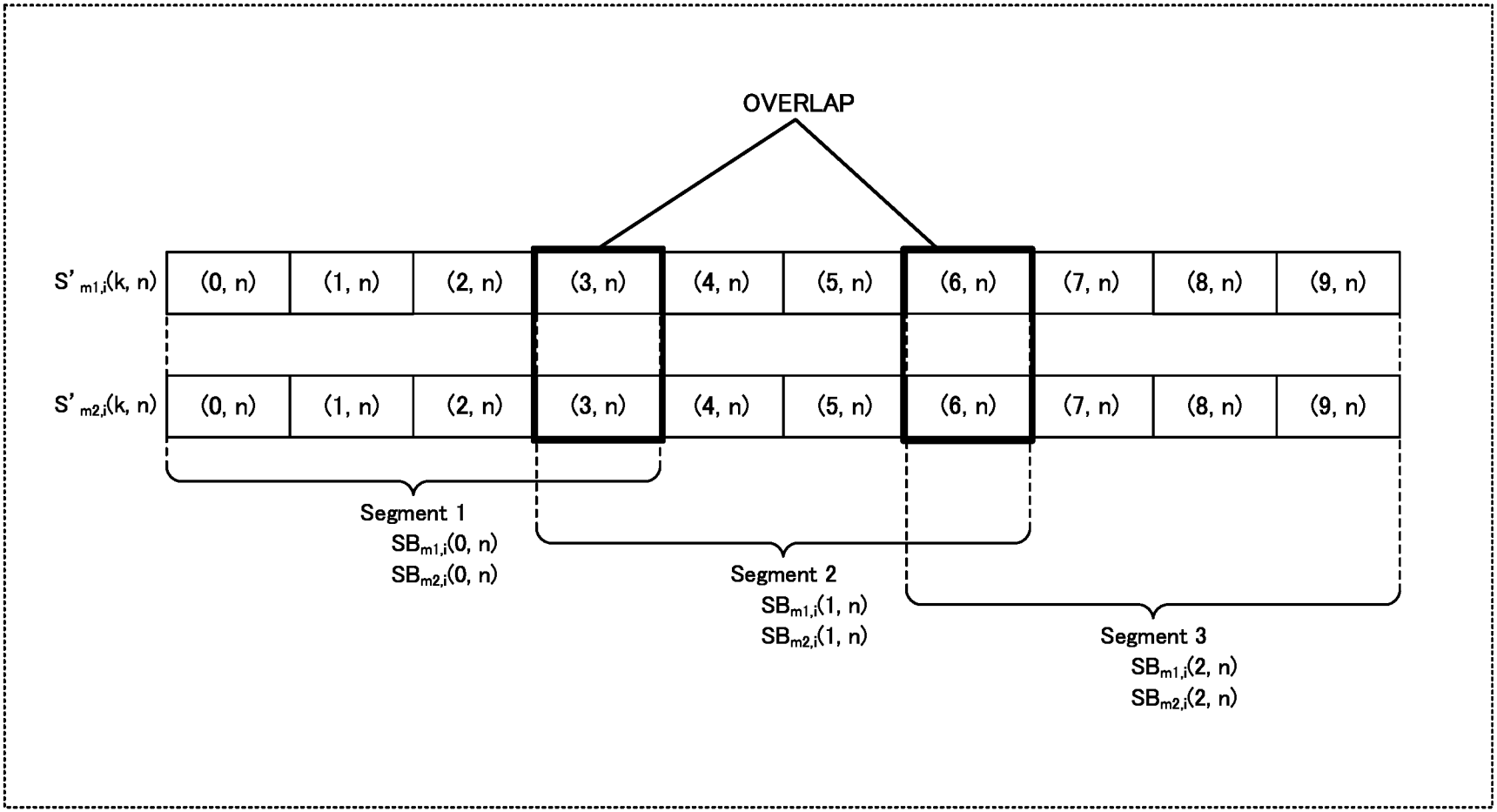
FIG. 5 illustrates an exemplary configuration of subbands according to an embodiment.

FIG. 5 illustrates an example in which spectrum $S'_{m1,ci[0]}(k,n)$ of the first acoustic signal and spectrum $S'_{m2,ci[1]}(k,n)$ of the second acoustic signal in the frame of the frame number n and corresponding to the ith acoustic object are divided into a plurality of subbands.

Each of the subbands illustrated in FIG. 5 is formed by a segment consisting of four frequency components (e.g., frequency bins).

Specifically, each of the subband spectra ($SB_{m1,ci[0]}(0, n)$, $SB_{m2,ci[1]}(0, n)$) in a subband (Segment 1) having subband number sb=0 is composed of four spectra ($S'_{m1,ci[0]}(k,n)$, $S'_{m2,ci[1]}(k,n)$) having frequency indexes k=0 to 3. Similarly, each of the subband spectra ($SB_{m1,ci[0]}(1, n)$, $SB_{m2,ci[1]}(1, n)$) in a subband (Segment 2) having subband number sb=1 is composed of four spectra ($S'_{m1,ci[0]}(k,n)$, $S'_{m2,ci[1]}(k,n)$) having frequency indexes k=3 to 6. Further, each of the subband spectra ($SB_{m1,ci[0]}(2, n)$, $SB_{m2,ci[1]}(2, n)$) in a subband (Segment 3) having subband number sb=2 is composed of four spectra ($S'_{m1,ci[0]}(k,n)$, $S'_{m2,ci[1]}(k,n)$) having frequency indexes k=6 to 9.

Here, as illustrated in FIG. 5, the frequency components included in the neighboring subbands partially overlap each other. For example, the spectra ($S'_{m1,ci[0]}(3, n)$, $S'_{m2,ci[1]}(3, n)$) having frequency index k=3 overlap each other between the subbands having subband numbers sb=0 and sb=1. Further, the spectra ($S'_{m1,ci[0]}(6, n)$, $S'_{m2,ci[1]}(6, n)$) having frequency index k=6 overlap each other between the subbands having subband numbers sb=1 and sb=2.

Such partial overlap of the frequency components between the neighboring subbands thus makes it possible for common component extractor 106 to overlap and add the frequency components at both ends of the neighboring subbands when synthesizing (reconstructing) the spectra so as to improve the connectivity (continuity) between the subbands.

Note that, the subband configuration illustrated in FIG. 5 is an example, and the number of subbands (in other words, the number of divisions), the number of frequency components constituting each subband (in other words, the subband size), and the like are not limited to the values illustrated in FIG. 5. In addition, the description with reference to FIG. 5 has been given in relation to the case where one frequency components overlap each other between the neighboring subbands, but the number of frequency components overlapping each other between subbands is not limited to one, and two or more frequency components may overlap.

Further, for example, the above-described subbands may be defined as subbands in which the subband size (or subband width) is an odd number of frequency components (samples), and subband spectra are multiplied by a bilaterally-symmetrical window having a center frequency component of 1.0 among the odd number of frequency components.

Additionally or alternatively, the subbands may have a configuration in which the subband width (e.g., the number of frequency components) is 2n+1, the 0th to the (n−1)th frequency components and the (n+1)th to the 2nth frequency components, for example, in each subband are ranges overlapping between neighboring subbands, and the neighboring subbands are shifted by one frequency component. In addition, only the nth component (in other words, the center frequency component) is multiplied by a gain calculated for each subband. That is, gains for the 0th to the (n−1)th and (n+1)th to 2nth frequency components in each subband are calculated from corresponding other subbands (in other words, subbands where the respective frequency components are centrally located). In this case, the spectra in the range of overlap between the neighboring subbands are used only for the gain calculation, and overlap and addition at the time of spectral reconstruction become unnecessary.

Further, the number of frequency components overlapping between the subbands may be variably set depending on, for example, the characteristics and the like of an input signal.

In FIG. 4, similarity-degree calculator 163 calculates the degree of similarity between the subband spectra of the first acoustic signal inputted from divider 162-1 and the subband spectra of the second acoustic signal inputted from divider 162-2. Similarity-degree calculator 163 outputs similarity information indicating the degree of similarity calculated for each subband to spectral-gain calculator 164.

For example, in FIG. 5, similarity-degree calculator 163 calculates the degree of similarity between subband spectrum $SB_{m1,ci[0]}(0, n)$ and subband spectrum $SB_{m2,ci[1]}(0, n)$ of the subbands having subband number sb=0. In other words, similarity-degree calculator 163 calculates the degree of similarity between the spectral shape (in other words, vector components) formed by four spectra $S'_{m1,ci[0]}(0, n)$, $S'_{m1,ci[0]}(2, n)$, and $S'_{m1,ci[1]}(3, n)$ of the first acoustic signal and the spectral shape (in other words, vector components) formed by four spectra $S'_{m2,ci[1]}(0, n)$, $S'_{m2,ci[1]}(2, n)$, and $S'_{m2,ci[1]}(3, n)$ of the second acoustic signal of the subbands having subband number sb=0.

Similarity-degree calculator 163 similarly calculates the degrees of similarity between the subbands having subband numbers sb=1 and 2. As is understood, similarity-degree calculator 163 calculates the degrees of similarity for a plurality of subbands obtained by division of the spectra of the first acoustic signal and the second acoustic signal.

One example of the degree of similarity is the Hermitian angle between the subband spectrum of the first acoustic signal and the subband spectrum of the second acoustic signal. For example, the subband spectrum (complex spectrum) of the first acoustic signal in each subband is denoted as "$s_1$," and the subband spectrum (complex spectrum) of the second acoustic signal is denoted as "$s_2$." In this case, Hermitian angle $\theta_H$ is expressed by the following equation:

(Equation 1)

$$\theta_H = \cos^{-1}\left(\left|\frac{|s_1^* s_2|}{\|s_1\| \cdot \|s_2\|}\right|\right) \quad [1]$$

For example, the degree of similarity between subband spectrum $s_1$ and subband spectrum $s_2$ is higher as Hermitian angle $\theta_H$ is smaller, while the degree of similarity between subband spectrum $s_1$ and subband spectrum $s_2$ is lower as Hermitian angle $\theta_H$ is larger.

Another example of the degree of similarity is normalized cross-correlation of subband spectra $s_1$ and $s_2$ (e.g., $\|s_1 * s_2|/(\|s_1\| \cdot \|s_2\|)|$). For example, the degree of similarity between subband spectrum $s_1$ and subband spectrum $s_2$ is higher as the value of the normalized cross-correlation is greater, while the degree of similarity between subband spectrum Si and subband spectrum $s_2$ is lower as the normalized cross-correlation is smaller.

Note that, the degree of similarity is not limited to the Hermitian angle or the normalized cross-correlation, and may be other parameters.

In FIG. 4, spectral-gain calculator 164 transforms the degree of similarity (e.g., Hermitian angle $\theta_H$ or normalized cross-correlation) indicated in the similarity information inputted from similarity-degree calculator 163 into a spectral gain (in other words, a weighting factor), for example, based on a weighting function (or a transform function). Spectral-gain calculator 164 outputs spectral gain Gain(sb, n) calculated for each subband to multipliers 165-1 and 165-2.

Multiplier 165-1 multiplies (weights) subband spectrum $SB_{m1,ci[0]}(sb, n)$ of the first acoustic signal inputted from divider 162-1 by spectral gain Gain(sb, n) inputted from spectral-gain calculator 164, and outputs subband spectrum $SB'_{m1,ci[0]}(sb, n)$ after multiplication to spectral reconstructor 166.

Multiplier 165-2 multiplies (weights) subband spectrum $SB_{m2,ci[1]}(sb, n)$ of the second acoustic signal inputted from divider 162-2 by spectral gain Gain(sb, n) inputted from spectral-gain calculator 164, and outputs subband spectrum $SB'_{m2,ci[1]}(sb, n)$ after multiplication to spectral reconstructor 166.

For example, spectral-gain calculator 164 may transform the degree of similarity (e.g., Hermitian angle) to the spectral gain using transform function $f(\theta_H)=\cos^x(\theta_H)$. Alternatively, spectral-gain calculator 164 may also transform the degree of similarity (e.g., Hermitian angle) to the spectral gain using transform function $f(\theta_H)=\exp(-\theta_H^2/2\sigma^2)$.

Figure 6:
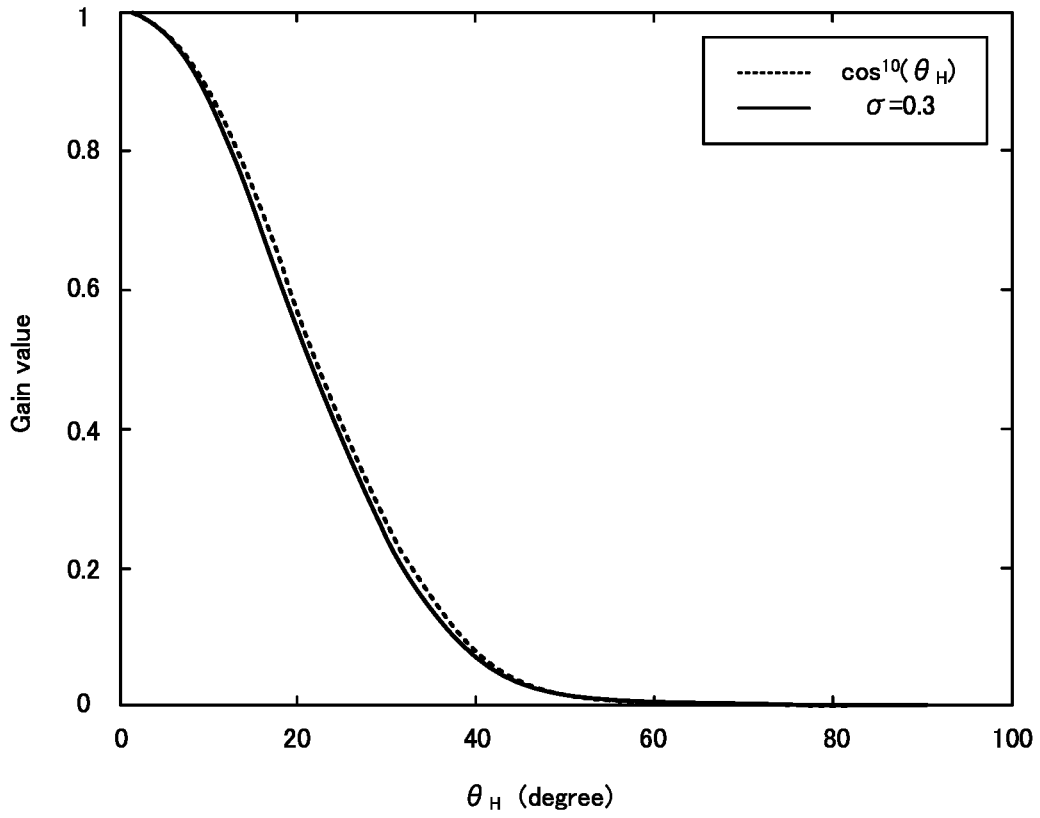
FIG. 6 illustrates an example of a transform function according to an embodiment.

For example, as illustrated in FIG. 6, the characteristics in the case of x=10 (i.e., $\cos^{10}(\theta_H)$) in transform function $f(\theta_H)=\cos^x(\theta_H)$ is substantially the same as the characteristics in the case of $\sigma=0.3$ in transform function $f(\theta_H)=\exp(-\theta_H^2/2\sigma^2)$. Note that, the value of x in transform function $f(\theta_H)=\cos^x(\theta_H)$ is not limited to 10, and may be another value. Note also that, the value of σ in transform function $f(\theta_H)=\exp(-\theta_H^2/2\sigma^2)$ is not limited to 0.3, and may be another value.

As illustrated in FIG. 6, the spectral gain (gain value) is greater (e.g., close to 1) as the Hermitian angle $\theta_H$ is smaller (as the degree of similarity is higher), while the spectral gain is smaller (e.g., close to 0) as the Hermitian angle $\theta_H$ is greater (as the degree of similarity is lower).

Thus, common component extractor 106 causes a subband spectral component to be left by performing weighting using a greater spectral gain for a subband of a higher degree of similarity, while attenuates a subband spectrum by performing weighting using a smaller spectral gain for a subband of a lower degree of similarity. Accordingly, common component extractor 106 extracts common components in the spectra of the first acoustic signal and of the second acoustic signal.

Note that the greater the value of x in transform function $f(\theta_H)=\cos^x(\theta_H)$ or the smaller the value of a in transform function $f(\theta_H)=\exp(-\theta_H^2/2\sigma^2)$, the steeper the gradient of transform function $f(\theta_H)$. In other words, when the distance of $\theta_H$ away from 0 (variation amount of $\theta_H$) is the same, the greater the value of x or the smaller the value of σ, the more the subband spectrum is attenuated because transform function $f(\theta_H)$ is closer to 0. Thus, the greater the value of x or the smaller the value of σ, the higher the degree of attenuation of the signal component of the corresponding subband, because the spectral gain drops sharply, for example, when the degree of similarity decreases even slightly.

For example, in a case where the value of x is great or the value of a is small (when the gradient of the transform function is steep), a non-target signal mixed even slightly in a subband spectrum lowers the degree of similarity to increase the degree of attenuation of the subband spectrum. Accordingly, when the value of x is great or the value of a is small, attenuation of the non-target signal (e.g., noise or the like) can be prioritized over extraction of the target acoustic object signal.

On the other hand, in a case where the value of x is small or the value of a is great (when the gradient of the transform function is gentle), a non-target signal mixed in a subband spectrum lowers the degree of similarity, but the degree of attenuation of the subband spectrum is weak. Accordingly, when the value of x is small or the value of a is great, protection for the target acoustic object signal is prioritized over attenuation of noise or the like.

As is understood, there is a trade-off relationship depending on the value of x or a between the protection for a signal component of the target acoustic object for extraction and the reduction of a signal component other than the extraction target. It is thus possible for common component extractor 106 to use a variable as the value of x or a (in other words, a parameter for adjusting the gradient of the transform function) to adaptively control the value, so as to control the degree at which the signal component other than the target acoustic object for extraction is to be left, for example.

Further, although the case where the similarity information indicates the Hermitian angle has been described here, the transform function may be similarly applied to the case where the similarity information indicates the normalized cross-correlation. That is, common component extractor 106 may use the transform function $f(C12)=(C12)^x$) with normalized cross-correlation $C12=\|s_1*s_2\|/(\|s_1\|\cdot\|s_2\|)\|$.

In FIG. 4, spectral reconstructor 166 reconstructs the complex Fourier spectrum of the acoustic object (ith object) using subband spectrum $SB'_{m1,ci[0]}(sb, n)$ inputted from multiplier 165-1 and subband spectrum $SB'_{m1,ci[1]}(sb, n)$ inputted from multiplier 165-2, and outputs the obtained complex Fourier spectrum $S'_i(k,n)$ to frequency-time transformer 167.

Frequency-time transformer 167 transforms complex Fourier spectrum $S'_i(k,n)$ (frequency-domain signal) of the acoustic object inputted from spectral reconstructor 166 into a time-domain signal. Frequency-time transformer 167 outputs obtained acoustic object signal $S'_i(t)$.

Note that, the frequency-time transform processing of frequency-time transformer 167 may, for example, be inverse Fourier transform processing (e.g., Inverse SFFT (ISFFT)) or inverse modified discrete cosine transform (Inverse MDCT (IMDCT)).

The operation of common component extractor 106 has been described above.

As described above, in acoustic object extraction apparatus 100, beamforming processors 103-1 and 103-2 generate the first acoustic signals by beamforming in the directions of arrival of signals from acoustic objects to microphone array 101-1 and generate the second acoustic signals by beamforming in the directions of arrival of signals from the acoustic objects to microphone array 101-2, and common component extractor 106 extracts signals including common components corresponding to the acoustic objects from the first acoustic signals and the second acoustic signals based on the degrees of similarity between the spectra of the first acoustic signals and the spectra of the second acoustic signals. At this time, common component extractor 106 divides the spectra of the first acoustic signals and the second acoustic signals into a plurality of subbands and calculates the degree of similarity for each subband.

Thus, acoustic object extraction apparatus 100 can extract the common components corresponding to the acoustic objects from the acoustic signals generated by the plurality of beamformers based on the subband-based spectral shapes of the spectra of the acoustic signals obtained by the plurality of beams. In other words, acoustic object extraction apparatus 100 can extract the common components based on the degrees of similarity considering a spectral fine structure.

For example, as described above, calculation of the degree of similarity is on a basis of subband including four frequency components in FIG. 5 in the present embodiment. Thus, in FIG. 5, acoustic object extraction apparatus 100 calculates the degree of similarity between the spectral shapes of fine bands each composed of four frequency components, and calculates the spectral gain depending on the degree of similarity between the spectral shapes.

In contrast, if calculation of the degree of similarity is on a basis of one frequency component (see, for example, PTL 1), the spectral gain is calculated based on the spectral amplitude ratio between frequency components. The normalized cross-correlation between one frequency components is always 1.0, which is meaningless in measuring the degree of similarity. For this reason, for example in PTL 1, a cross spectrum is normalized by a power spectrum of a beamformer output signal. That is, in PTL 1, a spectral gain corresponding to the amplitude ratio between the two beamformer output signals is calculated.

The present embodiment employs an extraction method based on a difference (or degree of similarity) between spectral shapes of the frequency components instead of the amplitude difference (or amplitude ratio) between the frequency components. Thus, even when two sounds respectively having particular frequency components of the same amplitude are inputted, acoustic object extraction apparatus 100 can determine a difference between a target object sound and the other object sound in the case where the spectral shapes are not similar to each other, so as to enhance the extraction performance of the target acoustic object sound.

In contrast, when calculation of the degree of similarity is on a basis of one frequency component, the only obtainable information on the difference between a target acoustic object sound and another non-target sound is the difference in the amplitude between the one frequency components.

For example, in a case where the signal level ratio between two different sounds in two beamformer outputs that are not the target acoustic object sound are similar to the signal level ratio between sounds arriving from the position of the target, their amplitude ratios are similar to each other. It is thus impossible to handle the sounds while distinguishing them between the sounds arriving from the position of the target and the sounds arriving from a different position that bring about a similar amplitude ratio.

In this case, if calculation of the degree of similarity is on a basis of one frequency component, the frequency component of a non-target sound is extracted wrongly as the frequency component of the target acoustic object sound, so as to be mixed wrongly as the frequency component from the position of the true target acoustic object sound.

On the other hand, in the present embodiment, acoustic object extraction apparatus 100 calculates a low degree of similarity when the spectral shape of a plurality of (e.g., four) spectra constituting a subband does not match the other spectral shape as a whole. Accordingly, in acoustic object extraction apparatus 100, there is a more distinct difference between the values of spectral gain calculated for a portion where the spectral shapes match each other and a portion where the spectral shapes do not match each other, so that a common frequency component (in other words, a similar frequency component) is further emphasized (left). Therefore, acoustic object extraction apparatus 100 offers a higher possibility of distinguishing between a sound different from a target sound and the target acoustic object sound even in the aforementioned case.

As described above, in the present embodiment, acoustic object extraction apparatus 100 extracts the common component on a basis of subband (in other words, on a basis of fine spectral shape). It is thus possible to avoid mixture of the frequency component of a non-target sound into the target acoustic object sound that is caused due to impossibility of distinguishing between particular frequency components of the target acoustic object sound and of a sound different from the target. Therefore, the present embodiment can enhance the extraction performance of the acoustic object sound.

For example, acoustic object extraction apparatus 100 is capable of improving subjective quality by appropriately setting the size of the subband (in other words, the bandwidth for calculation of the degree of similarity between spectral shapes) depending on characteristics such as the sampling frequency and the like of an input signal.

In addition, in the present embodiment, acoustic object extraction apparatus 100 uses a nonlinear function (for example, see FIG. 6) as the transform function for transforming the degree of similarity into the spectral gain. In this case, acoustic object extraction apparatus 100 can control the gradient of the transform function (in other words, the degree at which a noise component or the like is to be left) by setting a parameter (for example, the value of x or a described above) for adjustment of the gradient of the transform function.

Accordingly, the present embodiment makes it possible to significantly attenuate a signal other than the target signal by adjusting the parameter (for example, the value of x or a) such that the spectral gain sharply drops (the gradient of the transform function becomes steep) when the degree of similarity lowers even slightly, for example. Therefore, it is possible to improve the signal-to-noise ratio, in which a non-target signal component is taken as noise.

The embodiments of the present disclosure have been described above.

Note that the above embodiment has been described in relation to the case where combination information $C_i$ (e.g., ci[0] and ci[1]) is used for the combination of the first acoustic signal and the second acoustic signal that are the targets for extraction processing of common component extractor 106 for extracting the common component. However, among the first acoustic signals and the second acoustic signals, the combination (correspondence) of signals corresponding to the same acoustic object may be specified by a method other than the method using combination information $C_i$. For example, both beamforming processor 103-1 and beamforming processor 103-2 may sort acoustic signals in the order in which the acoustic signals come to correspond to a plurality of acoustic objects. Thus, the first acoustic signals and the second acoustic signals are outputted from beamforming processor 103-1 and beamforming processor 103-2 in the order in which the first and the second acoustic signals come to correspond to the same acoustic objects. In this case, common component extractor 106 may perform the extraction processing of extracting the common components in the order of the acoustic signals outputted from beamforming processor 103-1 and beamforming processor 103-2. Therefore, combination information $C_i$ is not required.

Further, although the above embodiment has been described in relation to the case where acoustic object extraction apparatus 100 includes two microphone arrays, acoustic object extraction apparatus 100 may include three or more microphone arrays.

In addition, the present disclosure can be realized by software, hardware, or software in cooperation with hardware. Each functional block used in the description of each embodiment described above can be partly or entirely realized by an LSI such as an integrated circuit, and each process described in the each embodiment may be controlled partly or entirely by the same LSI or a combination of LSIs. The LSI may be individually formed as chips, or one chip may be formed so as to include a part or all of the functional blocks. The LSI may include a data input and output coupled thereto. The LSI here may be referred to as an IC, a system LSI, a super LSI, or an ultra LSI depending on a difference in the degree of integration. However, the technique of implementing an integrated circuit is not limited to the LSI and may be realized by using a dedicated circuit, a general-purpose processor, or a special-purpose processor. In addition, a FPGA (Field Programmable Gate Array) that can be programmed after the manufacture of the LSI or a reconfigurable processor in which the connections and the settings of circuit cells disposed inside the LSI can be reconfigured may be used. The present disclosure can be realized as digital processing or analogue processing. If future integrated circuit technology replaces LSIs as a result of the advancement of semiconductor technology or other derivative technology, the functional blocks could be integrated using the future integrated circuit technology. Biotechnology can also be applied.

The present disclosure can be realized by any kind of apparatus, device or system having a function of communication, which is referred to as a communication apparatus. Some non-limiting examples of such a communication apparatus include a phone (e.g., cellular (cell) phone, smart phone), a tablet, a personal computer (PC) (e.g., laptop, desktop, netbook), a camera (e.g., digital still/video camera), a digital player (digital audio/video player), a wearable device (e.g., wearable camera, smart watch, tracking device), a game console, a digital book reader, a telehealth/telemedicine (remote health and medicine) device, and a vehicle providing communication functionality (e.g., automotive, airplane, ship), and various combinations thereof.

The communication apparatus is not limited to be portable or movable, and may also include any kind of apparatus, device or system being non-portable or stationary, such as a smart home device (e.g., an appliance, lighting, smart meter, control panel), a vending machine, and any other "things" in a network of an "Internet of Things (IoT)."

The communication may include exchanging data through, for example, a cellular system, a radio LAN system, a satellite system, etc., and various combinations thereof.

The communication apparatus may comprise a device such as a controller or a sensor which is coupled to a communication device performing a function of communication described in the present disclosure. For example, the communication apparatus may comprise a controller or a sensor that generates control signals or data signals which are used by a communication device performing a communication function of the communication apparatus.

The communication apparatus also may include an infrastructure facility, such as a base station, an access point, and any other apparatus, device or system that communicates with or controls apparatuses such as those in the above non-limiting examples.

The acoustic object extraction apparatus according to an exemplary embodiment of the present disclosure includes: beamforming processing circuitry, which, in operation, generates a first acoustic signal by beamforming in a direction of arrival of a signal from an acoustic object to a first microphone array, and generates a second acoustic signal by beamforming in a direction of arrival of a signal from the acoustic object to a second microphone array; and extraction circuitry, which, in operation, extracts a signal including a common component corresponding to the acoustic object from the first acoustic signal and the second acoustic signal based on a degree of similarity between a spectrum of the first acoustic signal and a spectrum of the second acoustic signal, in which the extraction circuitry divides the spectra of the first acoustic signal and the second acoustic signal into a plurality of frequency sections and calculates the degree of similarity for each of the plurality of frequency sections.

In the acoustic object extraction apparatus according to an exemplary embodiment of the present disclosure, frequency components included in each neighboring frequency section of the plurality of frequency sections partially overlap between the neighboring frequency sections.

In the acoustic object extraction apparatus according to an exemplary embodiment of the present disclosure, the extraction circuitry calculates a weighting factor depending on the degree of similarity for each of the plurality of frequency sections, and multiplies each of the spectrum of the first acoustic signal and the spectrum of the second acoustic signal by the weighting factor, and a parameter for adjusting a gradient of a transform function for transforming the degree of similarity into the weighting factor is variable.

An acoustic object extraction method according to an exemplary embodiment of the present disclosure includes: generating a first acoustic signal by beamforming in a direction of arrival of a signal from an acoustic object to a first microphone array, and generating a second acoustic signal by beamforming in a direction of arrival of a signal from the acoustic object to a second microphone array; and extracting a signal including a common component corresponding to the acoustic object from the first acoustic signal and the second acoustic signal based on a degree of similarity between a spectrum of the first acoustic signal and a spectrum of the second acoustic signal, in which the spectra of the first acoustic signal and the second acoustic signal are divided into a plurality of frequency sections and the degree of similarity is calculated for each of the plurality of frequency sections.

This application is entitled to and claims the benefit of Japanese Patent Application No. 2018-180688 dated Sep. 26, 2018, the disclosure of which including the specification, drawings and abstract is incorporated herein by reference in its entirety.

INDUSTRIAL APPLICABILITY

An exemplary embodiment of the present disclosure is useful for sound field navigation systems.

REFERENCE SIGNS LIST

100 Acoustic object extraction apparatus
101-1, 101-2 Microphone array
102-1, 102-2 Direction-of-arrival estimator
103-1, 103-2 Beamforming processor
104 Correlation confirmor
105 Triangulator
106 Common component extractor
161-1, 161-2 Time-frequency transformer
162-1, 162-2 Divider
163 Similarity-degree calculator
164 Spectral-gain calculator
165-1, 165-2 Multiplier
166 Spectral reconstructor
167 Frequency-time transformer

The invention claimed is:

1. An acoustic object extraction apparatus, comprising:

beamforming processing circuitry, which, in operation, generates a first acoustic signal by beamforming in a direction of arrival of a signal from an acoustic object to a first microphone array, and generates a second acoustic signal by beamforming in a direction of arrival of a signal from the acoustic object to a second microphone array; and extraction circuitry, which, in operation, extracts a signal including a common component corresponding to the acoustic object from the first acoustic signal and the second acoustic signal based on a spectral-gain transformed from a degree of similarity between a spectrum of the first acoustic signal and a spectrum of the second acoustic signal, wherein the extraction circuitry divides the spectra of the first acoustic signal and the second acoustic signal into a plurality of frequency sections and calculates the degree of similarity for each of the plurality of frequency sections, the degree of similarity being a parameter of high similarity as the degree of similarity approaches zero.

2. The acoustic object extraction apparatus according to claim 1, wherein frequency components included in each neighboring frequency section of the plurality of frequency sections partially overlap between the neighboring frequency sections.

3. The acoustic object extraction apparatus according to claim 1, wherein the extraction circuitry calculates a weighting factor depending on the degree of similarity for each of the plurality of frequency sections, and multiplies each of the spectrum of the first acoustic signal and the spectrum of the second acoustic signal by the weighting factor, and a parameter for adjusting a gradient of a transform function for transforming the degree of similarity into the weighting factor is variable.

4. An acoustic object extraction method, comprising:

generating a first acoustic signal by beamforming in a direction of arrival of a signal from an acoustic object to a first microphone array, and generating a second acoustic signal by beamforming in a direction of arrival of a signal from the acoustic object to a second microphone array; and extracting a signal including a common component corresponding to the acoustic object from the first acoustic signal and the second acoustic signal based on a spectral-gain transformed from a degree of similarity between a spectrum of the first acoustic signal and a spectrum of the second acoustic signal, wherein the spectra of the first acoustic signal and the second acoustic signal are divided into a plurality of frequency sections and the degree of similarity is calculated for each of the plurality of frequency sections, the degree of similarity being a parameter of high similarity as the degree of similarity approaches zero.

5. The acoustic object extraction apparatus according to claim 1, wherein the degree of similarity is a Hermitian angle.

6. The acoustic object extraction apparatus according to claim 5, wherein the smaller the Hermitian angle, the higher the gain value, and the larger the Hermitian angle, the lower the gain.

7. The acoustic object extraction apparatus according to claim 1, wherein the extraction circuitry transforms the degree of similarity into a spectrum gain by using a transform function.

8. The acoustic object extraction method according to claim 7, wherein the degree of similarity is a Hermitian angle.

9. The acoustic object extraction method according to claim 8, wherein the smaller the Hermitian angle, the higher the gain value, and the larger the Hermitian angle, the lower the gain.

10. The acoustic object extraction method according to claim 4, further comprising:

transforming the degree of similarity into a spectrum gain by using a transform function.

* * * * *